United States Patent [19]

Vandewege

[11] Patent Number: 4,673,113

[45] Date of Patent: Jun. 16, 1987

[54] HAT STRETCHER DEVICE

[75] Inventor: Orville Vandewege, Tempe, Ariz.

[73] Assignee: Lester Thompson, Apache Junction, Ariz.

[21] Appl. No.: 864,607

[22] Filed: May 19, 1986

[51] Int. Cl.[4] ..... D06C 5/00; A47G 25/10; A47G 25/66

[52] U.S. Cl. ..... 223/15; 223/52

[58] Field of Search ..... 223/52, 15, 61, 63, 223/65

[56] References Cited

U.S. PATENT DOCUMENTS

| | | | |
|---|---|---|---|
| 108,116 | 10/1870 | De La Mar | 223/15 |
| 1,214,335 | 1/1917 | Lynch et al. | 223/15 |
| 1,634,051 | 6/1927 | Parsch | 223/15 X |
| 2,363,982 | 11/1944 | Meltzer | 223/15 |

*Primary Examiner*—Werner H. Schroeder
*Assistant Examiner*—Andrew M. Falik
*Attorney, Agent, or Firm*—Herbert E. Haynes, Jr.

[57] ABSTRACT

A hat stretching device including a spaced apart pair of oppositely facing hat engaging arcuate bands which are interconnected by an adjustment block. One of the arcuate bands and the adjustment block cooperatively define a ratchet mechanism which allows the spacing between the hat engaging bands to be quickly, easily, and repeatable set to a coarsely adjusted size. The other arcuate band and the adjustment block cooperatively define a threaded adjustment mechanism which allows the spacing between the hat engaging bands to be finely adjusted to a precise hat engaging size.

10 Claims, 6 Drawing Figures

HAT STRETCHER DEVICE

BACKGROUND OF THE INVENTION

1. Field of the Invention

This invention relates generally to hat stretching devices and more particularly to an improved hat stretching device having simplified and repeatable size adjustment capabilities for facile installation in and removal from a hat to be stretched.

2. Brief Description of the Prior Art

Hat stretchers have been used for many years for maintaining hats in the proper shape during storage, drying, cleaning and the like. The most commonly used prior art hat stretchers include a pair of arcuate plates, or bands, having threaded rods extending therefrom with the rods being interconnected by a turnbuckle or similar structure. Manual rotation of the turnbuckle interacts with the threaded rods to move the arcuate band toward or away from each other to adjust the hat stretcher to the proper size for the hat to be stretched. Such prior art hat stretchers are disclosed in U.S. Pat. No. 389,104, issued to G. E. Schellman on Sept. 4, 1888 and in U.S. Pat. No. 3,459,347, issued to J. Navara on Aug. 5, 1969. This particular type of prior art hat stretcher is cumbersome to use in that it is difficult to hold the hat to be stretched, hold the hat stretcher in place within the hat and manually rotate the turnbuckle for sizing purposes all at the same time. Once this rather cumbersome installation and adjustment procedure is accomplished, is must be undone to remove the hat stretcher when the hat is to be used. Therefore, the cumbersome installation and size adjustment must be repeated each time the hat stretcher is to be used.

Other hat stretching devices have been used which are more properly described as hat expanders or hat blocking devices. Hat expanders of this second type are provided with four arcuate expander blocks which cooperatively define an oval configuration. A diametrically opposed pair of the expander blocks are interconnected by a turnbuckle type of adjustment structure and the other two blocks are connected to the diametrically opposed pair with suitable links and springs. Manual rotation of the turnbuckle causes all four of the expander blocks to move toward or away from each other. This type of hat expander is disclosed in U.S. Pat. No. 2,075,626 issued to H. Schlesinger on Mar. 30, 1937 and in U.S. Pat. No. 2,434,184 issued to C. F. Vlasis on Jan. 6, 1948. In addition to the increased complexity and costs of these second prior art hat expanders, in comparison to the hereinbefore discussed prior art hat stretchers, they have the same problem with regard to their being cumbersome to install and adjust, and such cumbersome installation and adjustment must be repeated each time they are to be used.

Therefore, a need exists for a new and improved hat stretcher device which overcomes some of the problems and shortcomings of the prior art.

SUMMARY OF THE INVENTION

In accordance with the present invention, a new and improved hat stretcher device is disclosed as including a quick release coarse adjustment latching means and a fine adjustment means which cooperate to provide simplified and repeatable installation in a hat to be stretched and to eliminate the prior art need for adjustment of the hat stretcher each time it is used.

The hat stretcher device of the present invention includes first and second arcuate plates, or bands which are disposed in spaced apart relationship with respect to each other for placement in bearing engagement within a hat to be stretched. The first arcuate plate has a threaded rod extending normally from the center of its concave surface and the second arcuate plate has a ratchet bar extending normally from the center of its concave surface. The first and second arcuate plates are arranged so that the threaded rod and ratchet bar extend toward each other and are in axial alignment with each other. An adjustment block is provided between the axially aligned threaded rod and ratchet bar for interconnection thereof and for providing the above mentioned adjustment capabilities of the hat stretcher.

The adjustment block is provided with a smooth axial bore on one end in which the ratchet bar is axially slidably movable and is further provided with a pawl means for normally engaging the ratchet bar for positioning thereof in a selected one of a plurality of axially extending positions. When a user pulls on the arcuate bands with a motion which will spread them apart, the ratchet bar will move axially to the desired extended position relative to the adjustment block and will be latched against retraction by interaction of the ratchet bar and the pawl means. The ratchet bar is provided with a plurality of annular ratchet grooves which are formed therealong in spaced increments to provide the plurality of axially extending positions of the ratchet bar and thereby provide a selection of coarse spacing adjustments between the first and second arcuate bands. The pawl means includes a release means by which the user can manually actuate the pawl means from its normal position of engaging the ratchet bar to a disengaged position wherein the ratchet bar is free to be moved into an axially retracted position relative to the adjustment block. These interactions of the ratchet bar, adjustment block, pawl means, and release means provide the quick release coarse adjustment latching means of the hat stretcher of the present invention.

The opposite end of the adjustment block has an internally threaded axial bore formed therein in which the threaded rod of the first arcuate band is mounted. When a user manually rotates the adjustment block, the threaded rod will move in either an axially extended or retracted direction relative to the adjustment block as determined by the direction of rotation of the adjustment block, and this provides the fine adjustment means of the hat stretcher of the present invention.

Accordingly, it is an object of the present invention to provide a new and improved hat stretching device.

Another object of the present invention is to provide a new and improved hat stretching device which includes a spaced apart pair of hat engaging arcuate bands with special adjustment means therebetween for initial establishment of the spacing between the bands at a precisely set extended position for use in a particular hat and for allowing the spacing between the bands to be easily reduced and returned to the same extended position to facilitate subsequent installation and removal of the device in the same hat or ones of similar size.

Another object of the present invention is to provide a new and improved hat stretching device of the above described character wherein the special adjustment means includes a quick release coarse adjustment latching means for setting and resetting the extended spacing between the two arcuate bands at a selected one of a plurality of coarse adjustment points and a fine adjustment means for precise adjustment of the extended spacing relative to the selected coarse adjustment point.

Another object of the present invention is to provide a new and improved hat stretching device of the above described character wherein the quick release coarse adjustment latching means includes a ratchet bar carried by one of the arcuate bands and a pawl means which latches the ratchet bar, and thus its arcuate band in a selected extended position and a pawl release means for disengaging the pawl means from the ratchet bar to allow it and its associated arcuate band to be moved from the extended position to a retracted position.

Another object of the present invention is to provide a new and useful hat stretching device of the above described type wherein the fine adjustment means includes a threaded rod carried by the other one of the arcuate bands to allow that band to be adjusted so as to provide precision adjustment of the extended spacing position between the two arcuate bands.

The foregoing and other objects of the present invention, as well as the invention itself, may be more fully understood from the following description when read in conjunction with the accompanying drawings.

DESCRIPTION OF THE PREFERRED EMBODIMENT

Figure 1:
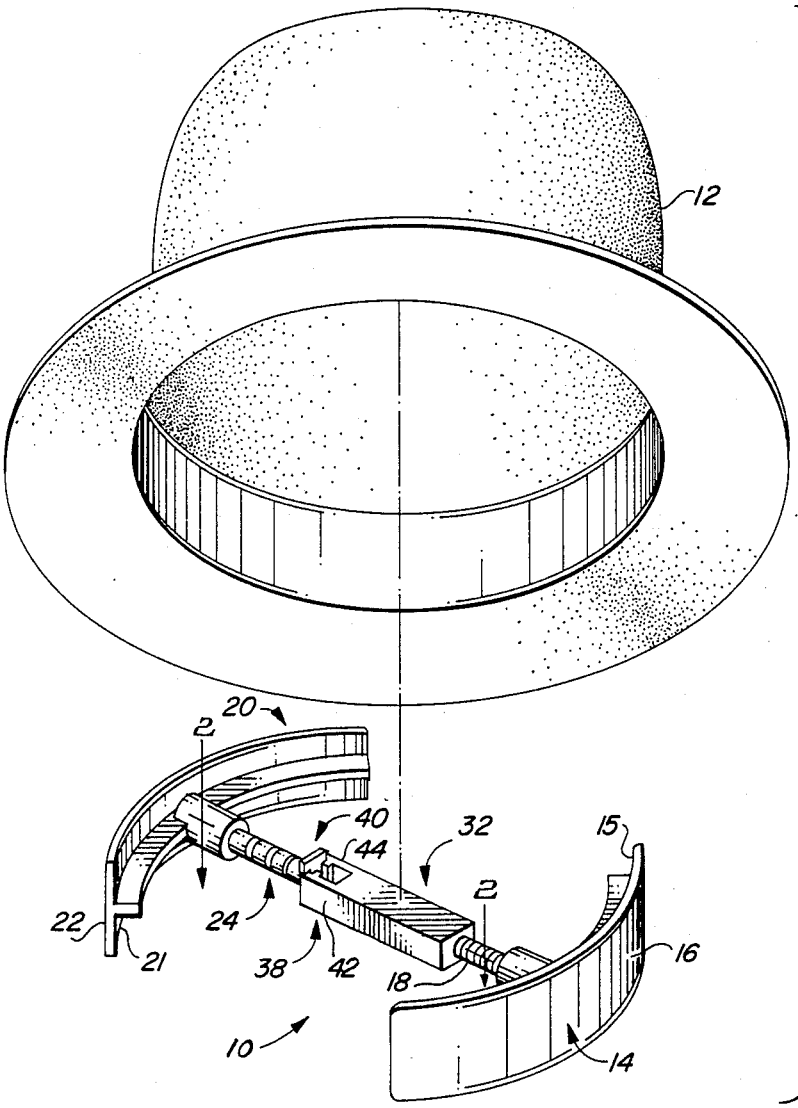
FIG. 1 is a perspective view of the hat stretching device of the present invention which is shown in exploded relationship with a typical hat to be stretched.

Referring more particularly to the drawings, FIG. 1 shows the hat stretcher device of the present invention which is indicated in its entirety by the reference numeral 10. The hat stretching device 10 is intended to be placed within a hat 12 for stretching and blocking purposes as will become apparent as this description progresses.

The hat stretching device 10 includes a first hat engaging means 14 in the preferred form of an arcuate band having a concave surface 15 and an opposite convex surface 16. A threaded rod 18 extends normally and centrally from the concave surface 15 of the arcuate band 14 and interacts, as will hereinafter be described, with other elements of the hat stretching device 10 to provide a fine adjustment capability.

A second hat engaging means 20 is provided, in the preferred form of an arcuate band having a concave surface 21 and an opposite convex surface 22, similar to the above described first hat engaging means 14. This second arcuate band 20 has a ratchet bar 24 extending normally and centrally from its concave surface 21. The ratchet bar 24 has a plurality of annular ratchet grooves 26 formed in spaced apart increments along its length with annular land areas 28 therebetween. Each of the annular grooves 26 is of saw-tooth configuration and is defined by an annular abutment surface 29 which lies in a plane that is perpendicular to the longitudinal axis of the ratchet bar 24, and a truncated conical cam surface 30 which slopes upwardly from the smallest diameter of the abutment surface 29 toward the free end of the ratchet bar 24 onto the adjacent one of the annular land areas 28. As will hereinafter be described in detail, the ratchet bar 24 interacts with other elements of the hat stretching device 10 to provide a quick release coarse adjustment latching capability.

As seen best in FIG. 1, the first and second hat engaging arcuate bands 14 and 20 are arranged in oppositely facing spaced apart relationship with respect to each other. The threaded rod 18 and the ratchet bar 24 extend from their respective arcuate bands 14 and 20 toward each other along a common axis and are interconnected by an adjustment block 32.

The adjustment block 32 has in internally threaded axial bore 34 on one of its ends and the threaded rod 18 is mounted therein. The threaded bore 34 and the threaded rod 18 interact to provide the hereinbefore mentioned fine adjustment capability of the hat stretching device 10 which is accomplished by manually rotating the adjustment block 32 on the threaded rod 18.

The adjustment block 32 is further provided with a smooth axial bore 36 in its opposite end and the ratchet bar 24 is axially movable in that smooth bore 36. Axial movement of the ratchet bar 24 in the smooth bore 36 of the adjustment block 32 is controlled by a pawl means 38 and a release means 40 which are provided on the opposite end of the adjustment block 32. The pawl means 38 and the release means 40 interact with the ratchet bar 24 to provide the hereinbefore mentioned quick release coarse adjustment latching capability as will now be explained in detail.

The pawl means 38 includes an opposed pair of resiliently deflectable arms 42 and 44 which extend integrally from the adjustment block 32 so as to lie on diametrically opposed sides of the ratchet bar 24. Each of the resiliently deflectable arms 42 and 44 is of relatively thin cross section which provides clearance spaces between the arms and their respective sides of the ratchet bar 24 and facilitates resiliently deflected movements of the arms 42 and 44 as will hereinafter be described in detail. The arm 42 has a tongue 46 extending normally and inwardly from its free end toward the ratchet bar 24 and an arcuate beveled notch 48 is formed centrally in the extending edge of the tongue 46. Further, the arm 42 has a normally and inwardly extending rib 50 which is disposed so as to provide a spaced relationship between the tongue 46 and the rib 50. Similarly, the other arm 44 has a tongue 52 which extends normally and inwardly from the free end of the arm toward the ratchet bar 24 and the tongue 52 is provided with an arcuate beveled notch 54 centrally in its extending edge. The arm 44 is further provided with a normally and inwardly extending rib 56 which is disposed so as to provide a spaced relationship between the tongue 52 and the rib 56.

The arms 42 and 44 of the pawl means 38 are normally in a ratchet bar engaging position wherein the arcuate beveled notches 48 and 54 of their respective tongues 46 and 52 are in bearing engagement with the ratchet bar 24. More specifically, when the ratchet bar 24 is axially moved in the bore 36 of the adjustment block 32 to a position where one of the annular ratchet grooves 26 thereof is in alignment with the tongues 46 and 52 of the pawl means 38, the beveled notches 48 and 54 will be seated in diametrically opposed sides of the aligned ratchet groove 26. When the ratchet bar 24 is moved so that one of the annular land areas 28 is in alignment with the tongues 46 and 52, the arms 42 and 44 will be spread apart, e.g. resiliently deflected, by cam action between the truncated conical surfaces 30 of the ratchet grooves 26 and the beveled surfaces of the notches 48 and 54 which places those notches in bearing engagement with the land areas 28.

In view of the resiliently deflectable nature of the pawl means 38 and the above described configurations of the ratchet bar 24 and the pawl means 38, those elements interact in the well known manner of a ratchet-pawl mechanism which allows the ratchet bar 24 to be moved in an extending direction relative to the adjustment block 32 and, when the tongues 46 and 52 are seated in one of the ratchet grooves 26 of the bar 24, the bar will be latched against movement in a retracted direction.

Therefore, the two hat engaging arcuate bands 14 and 20 of the hat stretching device 10 can be quickly and easily moved apart by ratchet action into a selected one of a plurality of coarsely adjusted locations. And, by utilizing this capability, a user can spread the arcuate bands 14 and 20 to a position which nearly matches the size of the hat 12 to be stretched.

Once the coarse adjustment of the hat stretching device 10 is made in the above described manner fine adjustment is made to suit the particular hat, or ones of similar size, by threaded movement of the threaded rod 18 relative to the adjustment block 32. As will become apparent as this description progresses, once this final adjustment is made of the hat stretching device 10, it need not be repeated as long as the hat stretching device is used in the same hat 12 or one of the same size.

As hereinbefore mentioned, the pawl means 38 is normally in engagement with the ratchet bar 24 and will latchingly hold the ratchet bar 24 against movement in a retracting direction relative to the adjustment block 32. The quick release feature of the hat stretching device 10 is provided by the release means 40 and reference is now made in particular to FIGS. 3 through 6 for the following description of the release means and its operation.

Figure 3:
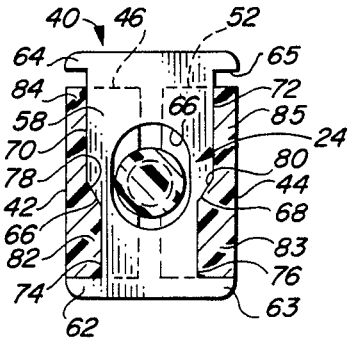
FIG. 3 is an enlarged fragmentary sectional view taken along the line 3—3 of FIG. 2 showing the release means in its normal position wherein the pawl means is in its ratchet bar engaging state.

As seen best in FIG. 3, the release means 40 is in the form of a planar plate 58 which is located between the resiliently deflectable arms 42 and 44 of the pawl means 38, and more specifically, is located in the space between the tongues 46 and 52 and the ribs 50 and 56 of those arms. The planar plate 58 is provided with a hole 60 through which the ratchet bar 24 passes and the hole is of oblong configuration to allow movement of the planar plate 38 between its disengaged position shown in FIG. 3 and its engaged position shown in FIG. 5, as will hereinafter be described in detail.

The planar plate 58 is movable in a plane which is normal with respect to the longitudinal axis of the ratchet bar 24 and its movement into its disengaged position (FIG. 3) is limited by a pair of oppositely extending ears 62 and 63 on its lower end as viewed in FIG. 3. Similarly, another pair of oppositely extending ears 64 and 65 are formed on the opposite end of the planar plate 58 to limit is movement into the engaged position.

The planar plate 58 of the release means 40 is formed with a reduced width dimension intermediate its upper and lower ends to provided angular cam surfaces 66 and 68 on its opposed side edges. The cam surfaces 66 and 68 are linear and slope angularly and inwardly from the more widely spaced portions 70 and 72 of the side surfaces, which are proximate the ears 64 and 65, to the more narrowly spaced portions 74 and 76 which are proximate the ears 62 and 63.

Similarly, the inwardly facing surfaces of the resiliently deflectable arms 42 and 44 are configured to provide angular cam surfaces 78 and 80 which are disposed to interact with cam surfaces 66 and 68 of the release means 40. The cam surfaces 78 and 80 are linear and extend angularly and outwardly from relatively thicker portions 82 and 83 of the arms 42 and 44 to relatively thinner portions 84 and 85 thereof. The thicker portions 82 and 83 of the deflectable arms 42 and 44 are located adjacent the narrowly spaced side portions 74 and 76 of the plate 58 of the release means 40 and the relatively thinner portions 84 and 85 are adjacent the more widely spaced side edge portions 70 and 72 of the planar plate 58. Therefore, the cam surfaces 78 and 80 of the deflectable arms 42 and 44 face oppositely and are in engagement with the cam surfaces 66 and 68 of the release means 40.

Figure 4:
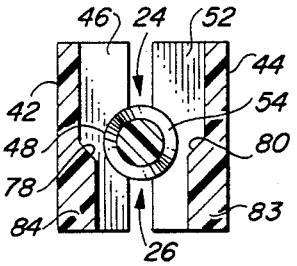
FIG. 4 is an enlarged fragmentary sectional view taken along the line 4—4 of FIG. 2 showing the pawl means in latching engagement with a selected one of the annular grooves of the ratchet bar.
Figure 2:
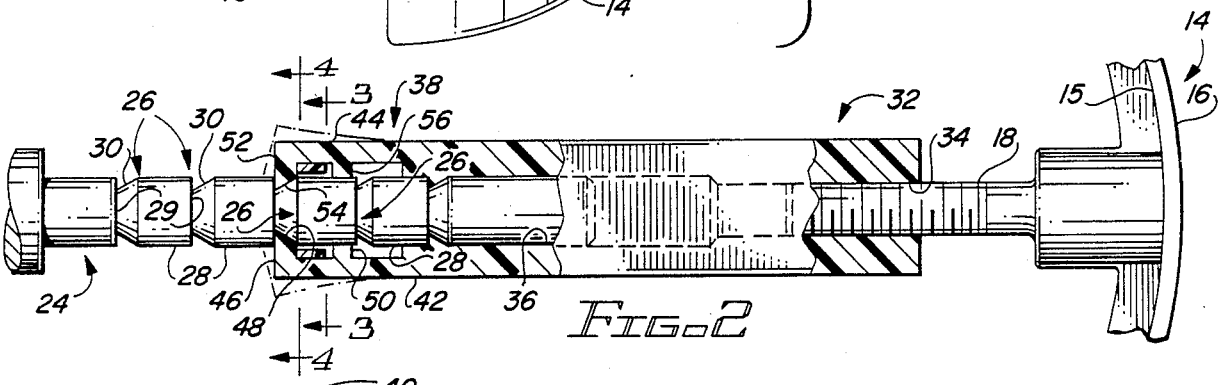
FIG. 2 is an enlarged fragmentary sectional view taken along the line 2—2 of FIG. 1.
Figure 5:
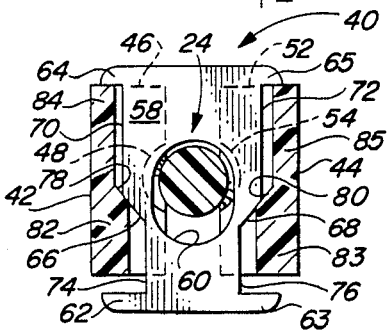
FIG. 5 is an enlarged fragmentary sectional view similar to FIG. 3 but showing the release means in its manually actuated position.

When the release means 40 is in the disengaged position shown in FIG. 3, its opposed side surfaces and cam surfaces 66 and 68 are in engagement with the inner surfaces and cam surfaces 78 and 80 of the resiliently deflectable arms 42 and 44, but, the release means 40 is not exerting any force on the arms 42 and 44. Therefore, in the disengaged position of the release means 40, the resiliently deflectable arms 42 and 44 of the pawl means 38 will be in their normal position as shown in FIG. 4.

Figure 6:
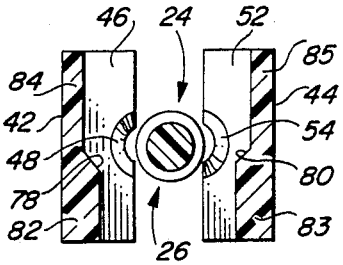
FIG. 6 is an enlarged fragmentary sectional view similar to FIG. 4 but showing the pawl means as being held out of ratchet bar engagement by the manually actuated release means.

Movement of the release means 40 into its engaged position, which is accomplished manually by the user, will cause the cam surfaces 66 and 68 of the planar plate 58 to bear against the cam surfaces 78 and 80 of the arms 42 and 44. The bearing force exerted in this manner will resiliently deflect the arms 42 and 44 to the position shown in FIG. 5, and this results in spreading of the tongues 46 and 52 out of bearing engagement with the ratchet bar 24 as shown in FIG. 6. Therefore, when the release means 40 is in its engaged position, the ratchet bar 24 is freed for movement in a retracting direction toward the adjustment block 32.

Operation of the above described hat stretching device 10 is believed to be readily apparent from the above description. However, to insure against any misunderstanding, the use of the device 10 will now be briefly described. When the hat stretching device is to be sized for the first time for use in a hat to be stretched, the user accomplishes what may be referred to as an initial installation and adjustment procedure which needs to be accomplished only once unless the hat stretcher is to be used on a hat of a different size. To accomplish this initial installation and adjustment procedure, the above described coarse adjustment is made first followed by the fine adjustment. In otherwords, the two arcuate hat engaging bands 14 and 20 are pulled apart until the spacing therebetween closely matches that of the hat to be stretched and the tongues 46 and 52 of the pawl means 38 latchingly engage whichever one of the arcuate ratchet grooves 26 provides the desired coarse adjustment spacing. Then the fine adjustment is made by rotating the adjustment block 32 to threadingly move the arcuate band 14 as needed to move both of the arcuate bands into bearing engagement with the inside surfaces of the hat. After the initial installation and adjustment procedure has been accomplished, the hat stretching device 10 can be removed from the hat 12 by simply manually moving the release means 40 to its engaged position and moving the ratchet bar 24 in a retracted direction to decrease the spacing between the two arcuate bonds. Then to reinstall the hat stretching device 10 in the same hat 12, or one of the same size, extending movement of the ratchet bar 24 back to the same coarse adjustment point selected in the initial adjustment procedure, which automatically returns the two arcuate bands of the stretching device 10 to the precise spacing set in the initial procedure.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A hat stretching device comprising:

(a) first and second band means for placement in a hat to be stretched, said band means being in spaced relationship with each other;

(b) a threaded rod extending from said first band means toward said second band means;

(c) a ratchet bar extending from said second band means toward said first band means and in axial alignment with said threaded rod, said ratchet bar having at least a spaced apart pair of ratchet grooves formed therein;

(d) adjustment block means having a threaded bore on one end in which said threaded rod is mounted and having a smooth bore in its opposite end in which said ratchet bar is axially movable;

(e) pawl means on the opposite end of said adjustment block means and having a ratchet bar engaging position wherein said ratchet bar is movable in an axially extending direction relative to said adjustment block means to move a selected one of the ratchet grooves of said ratchet bar into latched engagement with said pawl means, said pawl means being movable into a ratchet bar disengaging position; and (f) release means associated with said pawl means for manually moving said pawl means between its ratchet bar engaging and disengaging positions.

2. A hat stretching device as claimed in claim 1 wherein said first band means is of arcuate configuration having a convex hat engaging surface and an opposite concave surface from which said threaded rod extends centrally and normally.

3. A hat stretching device as claimed in claim 1 wherein said second band means is of arcuate configuration having a convex hat engaging surface and an opposite concave surface from which said ratchet bar extends centrally and normally.

4. A hat stretching device as claimed in claim 1 wherein said pawl means is normally in its ratchet bar engaging position and is resiliently deflectable to its ratchet bar disengaging position.

5. A hat stretching device as claimed in claim 1 wherein said ratchet bar is of circular cross section and each of said ratchet grooves is annular.

6. A hat stretching device as claimed in claim 5 wherein said pawl means includes a pair of resiliently deflectable arm means which extend from the opposite end of said adjustment block means on diametrically opposed sides of said ratchet bar, each of said pair of resiliently deflectable arms, being normally in the ratchet bar engaging position of said pawl means and being resiliently deflectable to the ratchet bar disengaging position thereof.

7. A hat stretching device as claimed in claim 5 wherein said ratchet grooves of said ratchet bar are each defined by an annular abutment surface which lies in a plane normal to the longitudinal axis of said ratchet bar and a truncated conical surface which slopes from the smallest diameter of the abutment surface toward said adjustment block means onto the periphery of said ratchet bar.

8. A hat stretching device as claimed in claim 7 wherein said pawl means comprises:

(a) a pair of resiliently deflectable arms extending integrally from the opposite end of said adjustment block means on diametrically opposed sides of said ratchet bar, each of said pair of resiliently deflectable arms being in spaced relationship with its one of the diametrically opposed sides of said ratchet bar and each having an extending end;

(b) a pair of tongues each extending substantially normally from the extending end of a different one of said pair of resiliently deflectable arms toward said ratchet bar; and (c) each of said pair of tongues defining a ratchet bar engaging means.

9. A hat stretching device as claimed in claim 8 wherein each of said pair of tongues defines an arcuate beveled notch which forms said ratchet bar engaging means.

10. A hat stretching device as claimed in claim 8 wherein said release means comprises:

(a) a planar plate having a hole formed therethrough and having opposed side edges each of which has a cam surface formed thereon, said planar plate lying in a plane normal to the longitudinal axis of said ratchet bar and being disposed between said pair of resiliently deflectable arms with said ratchet bar passing freely through the hole formed in said planar plate;

(b) each of said pair of resiliently deflectable arms having a cam surface formed on the surface thereof which faces toward said ratchet bar; and (c) said planar plate being movable between a disengaged position wherein said resiliently deflectable pair of arms are in their normal ratchet bar engaging position and an engaged position wherein the cam surfaces of said planar plate and said pair of resiliently deflectable arms interact to resiliently deflect said pair of resiliently deflectable arms to the ratchet bar disengaged positions thereof.

* * * * *